US005915690A

United States Patent [19]

Surya

[11] Patent Number: 5,915,690

[45] Date of Patent: Jun. 29, 1999

[54] ADJUSTABLE LOW PAPER SENSOR

[75] Inventor: Ronald Surya, Laguna Hills, Calif.

[73] Assignee: Troy Systems, Inc., Santa Ana, Calif.

[21] Appl. No.: 08/861,986

[22] Filed: May 22, 1997

[51] Int. Cl.[6] ..... B65H 7/02

[52] U.S. Cl. ..... 271/265.01; 250/559.4

[58] Field of Search ..... 271/38, 110, 152, 271/153, 154, 155, 145, 265.01, 258.01; 250/559.4

[56] References Cited

U.S. PATENT DOCUMENTS

| | | | |
|---|---|---|---|
| 3,902,713 | 9/1975 | Von Lühmann et al. . | |
| 3,968,364 | 7/1976 | Miller . | |
| 4,585,221 | 4/1986 | Lillibridge . | |
| 5,016,864 | 5/1991 | Nonami | 271/38 |
| 5,311,031 | 5/1994 | Gagliardo . | |
| 5,447,301 | 9/1995 | Renner | 271/152 |
| 5,507,478 | 4/1996 | Nottingham et al. | 271/110 |
| 5,622,364 | 4/1997 | Dutton et al. | 271/110 |
| 5,700,003 | 12/1997 | Sung | 271/110 |
| 5,842,694 | 12/1998 | Brooks et al. | 271/38 |

FOREIGN PATENT DOCUMENTS

| | | | |
|---|---|---|---|
| 60-262733 | 12/1985 | Japan | 271/152 |
| 2-198949 | 8/1990 | Japan | 271/38 |
| 2-310233 | 12/1990 | Japan | 271/38 |
| 420218 | 3/1967 | Switzerland | 271/152 |

*Primary Examiner*—Janice L. Krizek
*Assistant Examiner*—Thuy V. Tran
*Attorney, Agent, or Firm*—Price, Gess & Ubell

[57] ABSTRACT

A sensor is disclosed for use with a paper feeding machine such as a printer, copier, or the like wherein a removable module comprises a paper source, the sensor determining when the paper in said module reaches a predetermined level corresponding to a low paper condition indicating the need to refill the cartridge. The sensor is mountable in the paper feeding machine adjacent the insertion point of the module, where a lever extending into the path of the module detects the presence and absence of the module. An arm is biased away from the insertion point of the module when the lever is in the position indicating no module, which allows the module to be inserted into the machine without interference with the arm, and is biased to contact the uppermost sheet of paper in the module when the lever indicates the presence of the module. Dominant and subservient springs operating in opposite directions are preferably used to accomplish the biasing of the arm and lever, and a rod contacting the lever and the arm is used to communicate the position of the lever to the arm and determine the position of the arm. The sensor also preferably includes an interrupter plate which rotates in a fixed relationship with the arm, such that a position of the arm in contact with the paper corresponding to a low paper level condition also determines the corresponding position of the interrupter plate. A circuit, such as a light emitter and light detector, can be placed such that the interrupter plate pivots between the light emitter and light detector only when the arm member is in the position corresponding to the low paper level condition. In a preferred embodiment, the position of the circuit can be adjusted by the user to vary the position at which the low paper condition occurs.

16 Claims, 4 Drawing Sheets

ADJUSTABLE LOW PAPER SENSOR

BACKGROUND OF THE INVENTION

1. Field of the Invention

The present invention relates to sensors for use in paper feeding machines such as copier, printers, and the like, and particularly to a sensor for indicating a paper supply condition in said machine.

2. Description of Related Art

Paper feeding machines which utilize cassettes such as removable paper trays to supply paper to the machine are plentiful in the art. Copiers, printers, facsimile machines, and other such devices have become prevalent in today's work place and their operation has become integral to the success of many businesses throughout the world. A typical machine takes stock paper from a tray and processes the paper in some way to yield the finished product at some output port. The supply of stock paper must be replenished from time to time as the paper in the cassette is used up. Essential to the operation of such machines is a uninterrupted supply of stock paper available on demand. Since the paper supply is typically located within the machine, and thus hidden from view, it becomes necessary to alert an operator when the paper supply is almost depleted so that the cassette can be refilled before the paper is exhausted. When the paper is supplied by a removable tray, the need for an indication of a low paper status is magnified because the storage capacity of the tray is typically less than the storage capacity of a dedicated compartment, and hence more likely to run out. For Example, Hewlett Packard manufactures several printers with removable trays having 250 sheet capacity and 500 sheet capacity, whereas some larger machines have dedicated compartments with storage for several thousands of sheets of paper.

In order to ensure a constant supply of paper, sensors have been developed to alert the machine's operator when the paper supply is low. Several attempts have been made to produce a low paper sensor which is readily adaptable to existing paper feeding machines, is small, lightweight, easy to manufacture, and reliable, but thus far no satisfactory sensor meets all of these goals.

Von Lühmann et al., U.S. Pat. No. 3,902,713, teaches a photoelectric device adapted for maintaining the height of a stack of papers. The reference shows a light source directed at a spherical or cylindrical object resting on the surface of the stack of papers and having a reflective surface. On the other side of the light source is a photosensitive device which receives the light reflected off the object when the stack of papers is at the correct height. As the paper is depleted, the angle of incidence from the object becomes such that light is no longer reflected to the photosensitive device, which signals a motor to increase the height of the stack of paper. The device is adapted primarily for small changes in the height of the stack of papers, although the object's path can be altered as paper is removed to increase or decrease the sensitivity of the device.

Lillibridge, U.S. Pat. No. 4,585,221 discloses a sensor for determining a low envelope condition in an envelope forming machine. The reference shows a light emitting and light receptor aligned and directed at a stack of envelopes, where the light reflected off the stack of envelopes from the light source is received by the light receptor as long as envelopes are in the chute. By placing the sensor at various places along the chute, the number of envelopes in the chute which will cause a low envelope condition to occur, i.e., no light reflected of the stack of envelopes, can be varies to suit the user. This sensor is not easily adaptable to present paper trays and is relatively imprecise in its measure of the number of envelopes present.

Miller, U.S. Pat. No. 3,968,364 discloses an apparatus wherein the position of a follower arm causes a light circuit to be interrupted when a paper tray becomes sufficiently empty. Miller's sensor cannot determine the presence of a tray of paper and is not easily adapted to mount inside existing paper feeding machines, nor does Miller disclose the novel construction of the present invention.

OBJECTS AND SUMMARY OF THE INVENTION

The present invention solves the problems and limitations of the prior art in a novel and creative way. A sensor is provided that is mountable inside a paper feeding machine within the cavity which receives a paper tray or cassette. The sensor is positioned to lie just above the path defined by the leading edge of the tray so that the tray can be inserted and removed without interference from the sensor. A lever extending below this plane is triggered when a tray is inserted, which causes an arm to rotate from a withdrawn position to an engaged position in contact with the paper in the tray. That is, the arm member is biased above the plane of the tray when no tray is present, but is biased below the plane of the tray when a tray in inserted into the cavity. The arm member will form a shallow angle with the horizon if the paper tray is fill, and the angle will grow steeper as the paper level is depleted. Thus, the angle at which the arm contacts the paper indicates the level of the paper, and this information can be communicated to a microprocessor or other monitoring means to indicate the paper status. Also, a critical angle can be determined a priori corresponding to a low paper level condition, and a signal can be generated when this critical angle is achieved.

To generate the signal, a circuit is provided which is broken (or alternatively completed) when the arm reaches the critical angle, such as in a preferred embodiment where a light source and light receptor cooperating to form a photoelectric circuit are eclipsed by an extension of the arm when the arm rotates to the critical angle. This eclipse interrupts the circuit which can be relayed to a microprocessor for alerting the operator that the paper is almost out. Springs initially bias the arm in the retracted position in order to allow the tray of paper to be inserted, and when a tray is present, bias the arm against the paper tray in its operable position. Additionally, by positioning the circuit at various locations via a circuit locating knob, the level of paper at which the low paper condition occurs can be controlled by the operator. Cables may be provided which power the circuit and communicate the status of the low paper condition to a microprocessor on the paper feeding machine or other signaling means.

BRIEF DESCRIPTION OF THE DRAWINGS

For a better understanding of the present invention, reference is made to the following description of the exemplary embodiments considered in conjunction with the accompanying drawings, in which.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art since the general principles of the present invention have been defined herein specifically to provide a low paper sensor for use in automated paper feeding machines.

Figure 1:
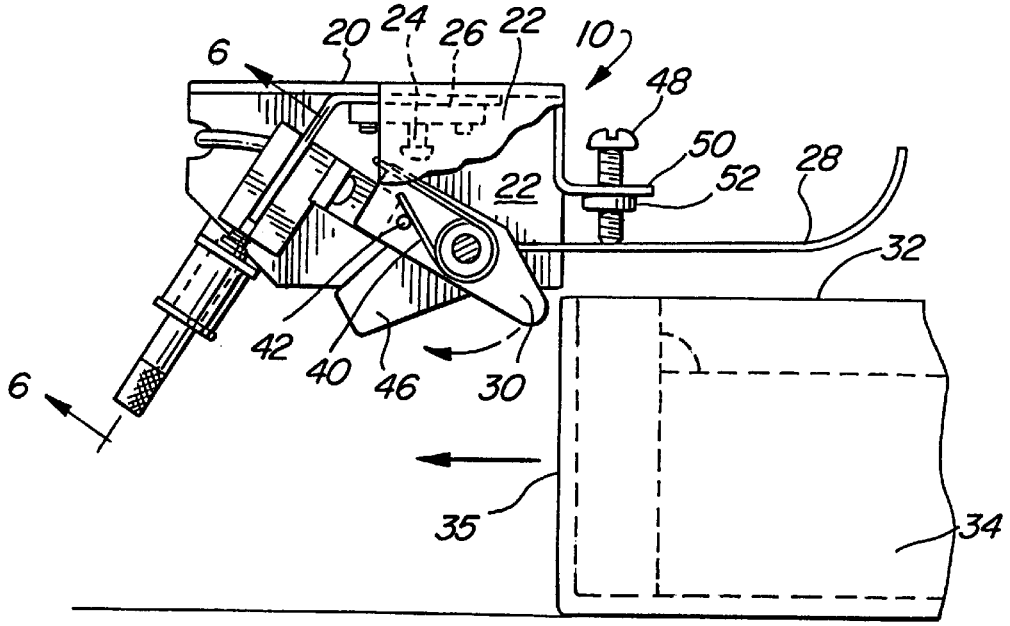
FIG. 1 is a cut-away view illustrating the sensor in a retracted position just prior to paper tray insertion.
Figure 2:
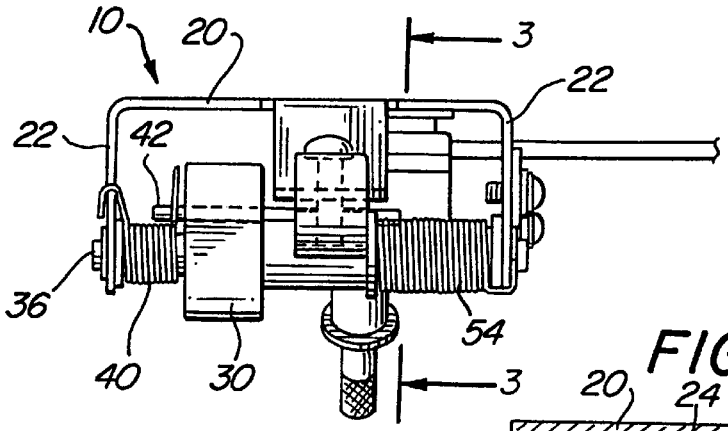
FIG. 2 is a front view of the sensor.
Figure 3:
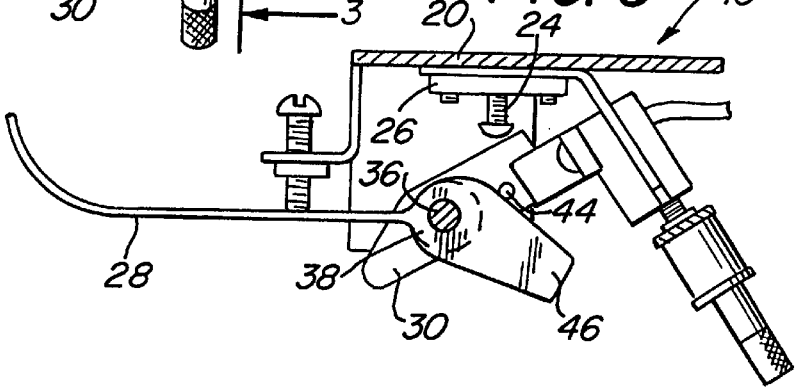
FIG. 3 is a side view of the sensor showing the traverse rod.

A low paper sensor adaptable for use in a wide variety of common paper feeding machines is generally illustrated in FIG. 1. The sensor operates by detecting the rotation of an arm in contact with the upper sheet of a paper tray, and causing a signal to be sent when the rotation indicates a level of paper corresponding to a pre-set low paper condition. A preferred embodiment will now be described in detail. Referring to FIGS. 1–3, the sensor 10 is preferably enclosed in a housing having a traverse plate 20 connecting two side plates 22, where the traverse plate 20 includes a fastener 24 and bracket 26 for limiting rotation of an interrupter plate 46 as will be discussed more fully below. The sensor 10 is positioned as shown in FIG. 1 with the arm member 28 directed towards the entrance of the paper cavity and the lever 30 extending below the plane 32 of the tray 34. The arm member 28 remains in a retracted position so that the tray 34 can be inserted without interference from the arm member 28 using a spring system as described below.

Figure 8:
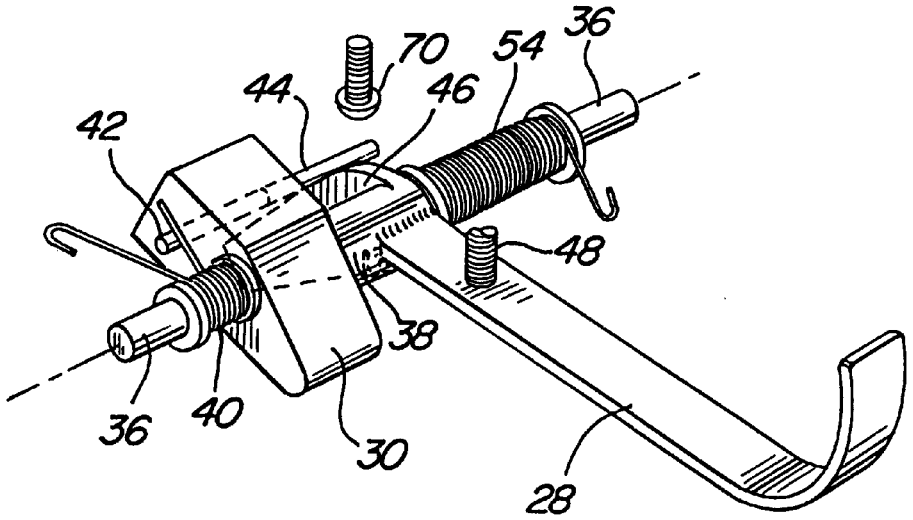

The arm member 28 is mounted to a shaft 36 which spans the housing and is connected at the side plates 22. The arm member 28 forms a hub structure 38 at the end which permits rotation of the arm member 28 about the shaft 36. The lever 30 is also mounted on the shaft 36 for rotation thereabout. As will be shown, the rotation of the lever 30 and the arm member 28 are coupled together and are influenced by springs which bias each element in a predetermined direction. The system of springs and connecting rods bias the arm member 28 in a retracted position and an engaged position depending on whether the lever 30 is deflected indicating the presence of a paper tray 34. A spring 40 engages traverse rod 42 protruding from the lever 30 to bias the lever 30 into its position below the plane of the tray. Connected to the lever 30 on the upper half is a second traverse rod 44 which is fixed in a position generally parallel with the shaft 36 and moves with the upper half of the lever 30. The traverse rod 44 contacts an interrupter plate 46 which is mounted to the hub 38 of the arm member 28 and adapted to rotate therewith in a fixed relationship. The spring 40 consequently communicates a force on the lever 30, which is transferred to the arm member 28 at the interrupter plate 46 via the traverse rod 44, biasing the arm member 28 upward into the retracted position (see FIG. 8). A stop is positioned along the path of the arm member 28 to establish the limit of the retracted position, such as the screw member 48 shown in FIG. 1. The screw member 48 is threaded through the bracket 50 and secured with lock nut 52, and this allows the retracted position of the arm member 28 to be adjusted in case larger trays must be accommodated. Furthermore, the limit on the rotation of the arm member 28 by screw member 48 establishes the maximum forward rotation of the lever 30, ensuring that the lever 30 will be angled at the proper position shown in FIGS. 1 and 3. This position allows the lever 30 to contact the front edge 35 of the tray 34 as the tray is inserted into its operable position.

Figure 4:
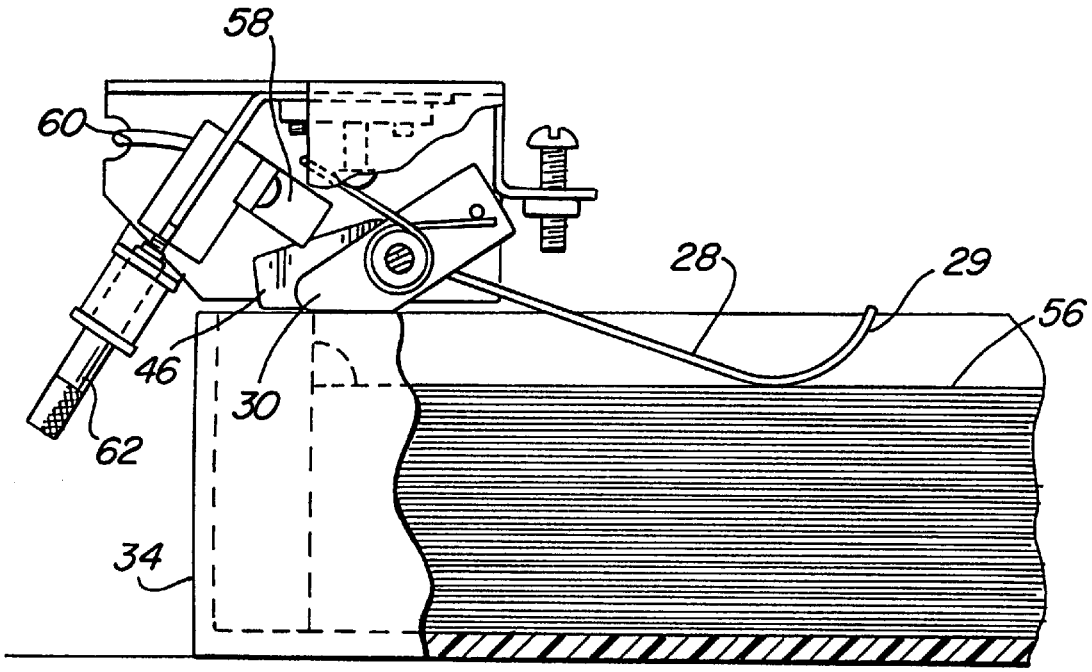
FIG. 4 is a side view of the sensor with a paper tray inserted.
Figure 9:
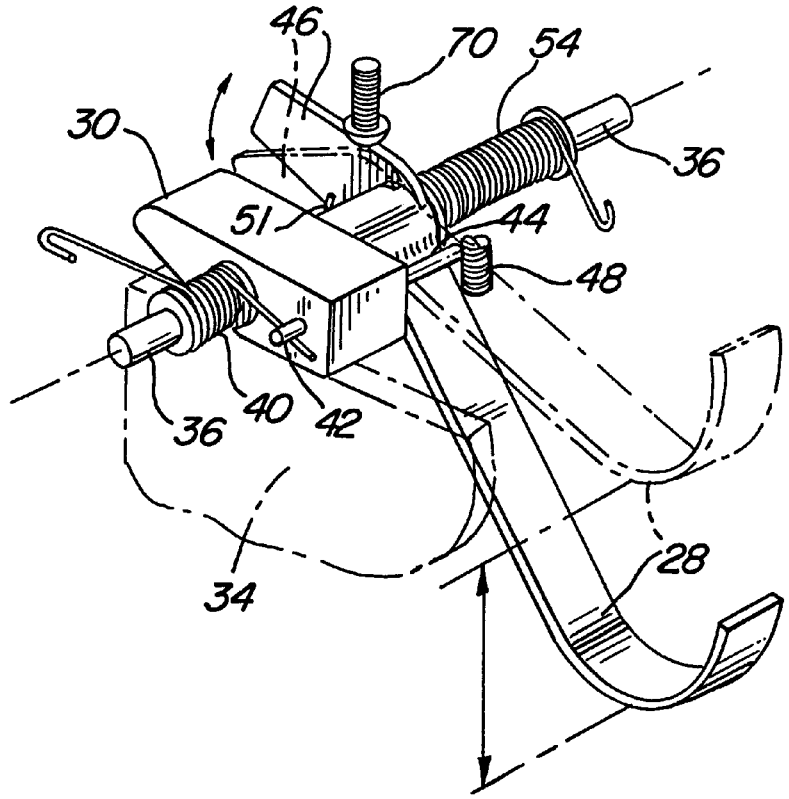

The movement of the elements will now be described with reference to FIGS. 4 and 5 in which a tray 34 is now inserted into the cavity. The tray's insertion causes the lever 30 to be retracted or rotated backwards towards the rear of the cavity against the force of the spring 40. When the tray 34 is fully inserted, the lever 30 is in the withdrawn position as shown (see FIG. 9). The rotation of the lever 30 causes a corresponding rotation of the traverse rod 44 away from the direction of the force applied to the interrupter plate 46, thereby relieving the arm member of the influence of spring 40. A second spring 54 is provided on the shaft 36 adjacent the arm member 28 which operates in a direction opposite the first spring 40, and engages the interrupter plate 46 via hooked end 51. The second spring 54, which is necessarily weaker than the first spring 40, biases the interrupter plate 46 and the arm member 28 in the opposite direction, down onto the tray of paper 34 when said arm member is no longer under the influence of the first spring 40. The second spring 54 achieves this biasing because the rotation of the lever 30 causes the traverse rod 44 to disengage with the interrupter plate 46 which allows the second spring 54 to act on the interrupter plate 46 in the opposite direction. In this manner, the arm member 28 engages the paper tray 34 only when the lever 30 is withdrawn by the paper tray. This dual spring system allows insertion of the tray 34 into the cavity without interference from the arm member 28, but also causes the arm member to instantly engage the paper tray 34 after it is inserted without operator interaction with the sensor. This is important, since the sensor will typically be located within the cavity of the paper tray receiving port and therefore manipulation should be minimal.

Figure 5:
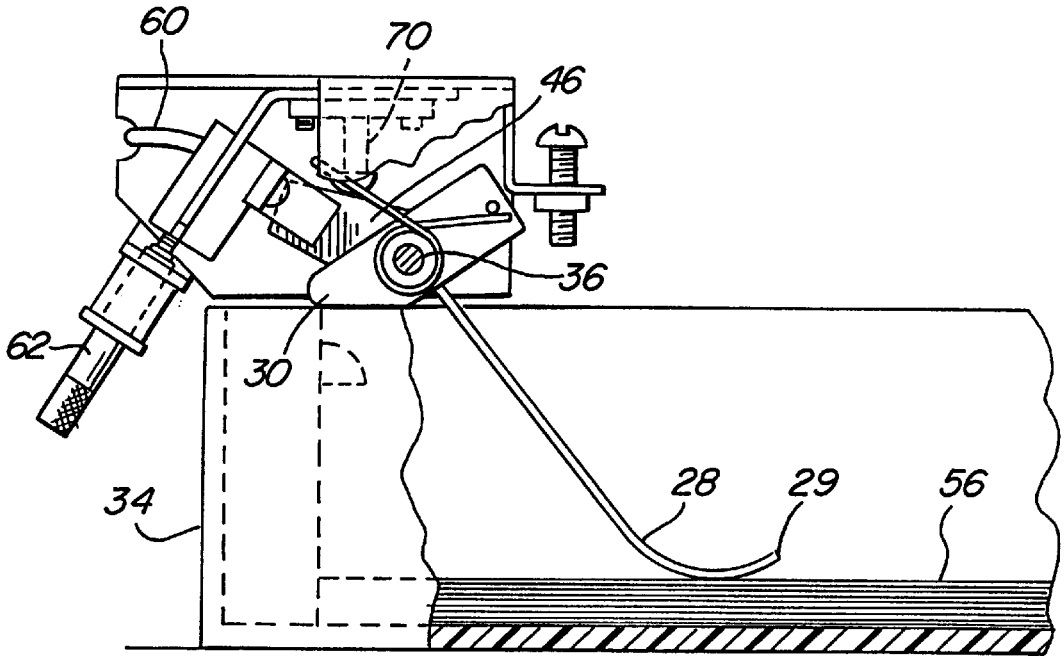
FIG. 5 is a side view of the sensor with a low paper status in said tray.

Turning now to FIG. 5, the depletion of paper and the operation of the sensor's low paper condition signal will be described. As paper is withdrawn from the paper tray 34, the stack of paper 56 will decrease in height and the arm member 28 will track this height by remaining in constant contact with the upper sheet of the paper. The arm member 28 is provided with a curved foot 29 for an end because this configuration is especially suited for this function. As the arm member 28 tracks the paper height, the interrupter plate 46 on the opposite side of the arm member 28 rotates in a fixed relationship about the shaft 36. The angular position of the interrupter plate 46 can be ascertained for a predetermined arm member location, and so the position of the interrupter plate 46 can be determined when the paper in the tray has reached a low paper condition. To alert the operator when the low paper condition has occurred, a circuit such as an optical sensor 58 is positioned at the predetermined position of the interrupter plate 46 which will be completed or interrupted by the presence of the interrupter plate 46, thereby indicating a low paper condition. As the interrupter plate 46 rotates in conjunction with the arm member 28, the interrupter plate 46 passes between a slotted optical switch comprising an input diode and output photo transistor, thereby interrupting the circuit. A signal is generated communicating this event to a microprocessor (not shown) via cable 60 which interprets this signal as a low paper condition. Appropriate lights or warnings are given to the operator that the paper height has reached a level corresponding to the predetermined low paper condition, and that the paper supply needs to be replenished. Although the paper stack may be further depleted, a stop 70 is provided at the exit of the circuit to maintain the interrupter plate between the two circuit elements to prevent the false elimination of the low paper indication.

Figure 6:
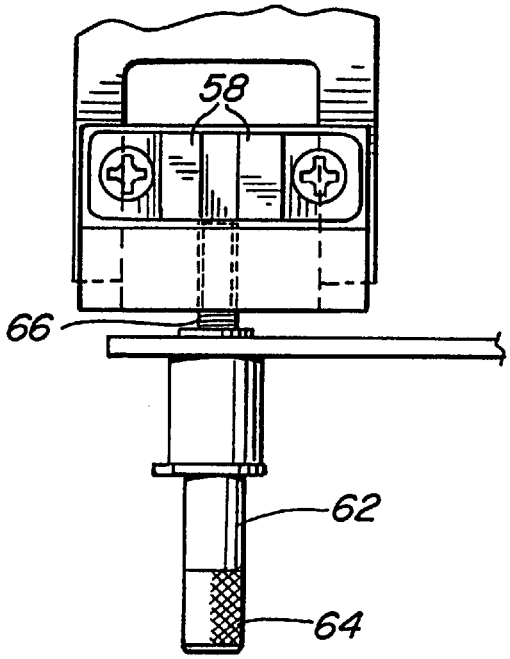
FIG. 6 is a mechanism for adjusting the position of the circuit.
Figure 7:
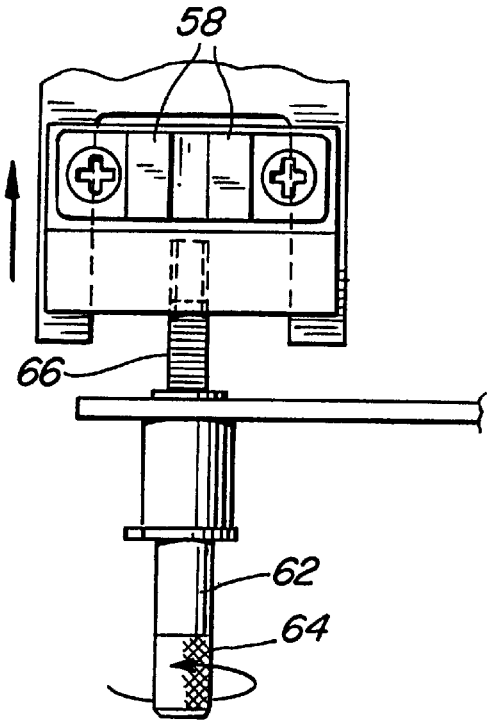
FIG. 7 is the mechanism with the circuit extended.

An important feature of the present invention is that the position of the optical sensor 58 is adjustable, allowing the operator to change the location of the arm member 28 (and corresponding paper height) at which the low paper condition occurs. FIGS. 6 and 7 illustrate a threaded rod 62 having a knob 64 on one end and the circuit 58 comprising the input diode and output photo transistor mounted at the other end. Rotation of the knob 64 will be communicated to the circuit, which will in turn be extended or withdrawn depending on the orientation of the threads 66. This adjustment feature determines where on the arc defined by the path of the interrupter plate the circuit break occurs, and consequently when the signal is sent indicating a low paper status.

It will be understood that the embodiment described herein are merely exemplary and that a person skilled in the art may make many variations and modifications without departing from the spirit and scope of the invention. All such variations and modifications are intended to be included within the scope of the invention as defined in the appended claims.

What is claimed is:

1. A sensor for detecting a low paper status of a removable tray including a stack of paper comprising:

a base mountable adjacent said tray;

a lever detecting the presence of said tray;

a retractable arm pivotally mounted to said base and adapted to contact an upper sheet of paper within said tray, an angular deflection of said retractable arm contacting said upper sheet of paper thereby establishing a height of said stack of paper;

means for biasing said retractable arm in a retracted position when said lever does not detect the presence of said tray, and for biasing said arm member in contact with said upper sheet of paper when said lever detects the presence of said tray;

a position adjustable sensor cooperating with said retractable arm to determine when the height of said upper sheet of paper has reached a predetermined level, where said predetermined level is set based on a selected position of said sensor; and a signal cooperating with said position adjustable sensor to alert when said upper sheet has reached said predetermined level.

2. A sensor apparatus for detecting a low paper status of a removable tray of paper for use in a paper feeding machine comprising:

detecting means for detecting the presence and the absence of a tray of paper in said machine;

pivoting means mountable above said tray of paper for rotational contact with an upper surface thereof, said rotational contact determining a height of said paper in said tray, said pivoting means having a retracted position for allowing insertion of said tray of paper in said paper feeding machine, and an operable position wherein said pivoting means contacts said upper surface of said tray to determine a height thereof;

spring means for biasing said pivoting means in said retracted position when said detecting means detects the absence of said tray of paper, and for biasing said pivoting means in said operable position when said detecting means detects the presence of said tray of paper; and means cooperating with said pivoting means for determining when said pivoting means has reached a predetermined adjustable position indicating a low paper condition.

3. The sensor apparatus as recited in claim 2 wherein said means for determining when said pivoting means has reached the predetermined adjustable position comprises an opaque member radially spaced from said pivoting member and mounted to pivot therewith, and a light circuit comprising an illumination source and an illumination receptor cooperating to form a light circuit when said path between said illumination source and said illumination receptor is unimpeded, said light circuit positioned such that said opaque member pivots into a position between said illumination source and said illumination receptor when said arm member in its operable position contacts an upper sheet corresponding to a low paper level condition.

4. The sensor apparatus as recited in claim 2 wherein said means for determining when said pivoting means has reached the predetermined adjustable position comprises an opaque member radially spaced from said pivoting member and mounted to pivot therewith, and a light circuit comprising an illumination source and an illumination receptor cooperating to form a light circuit when said path between said illumination source and said illumination receptor is unimpeded, said light circuit positioned such that said opaque member is interposed between said illumination source and said illumination receptor when said arm member in its operable position contacts an upper sheet not corresponding to a low paper level condition, and pivoting to a position no longer between said illumination source and said illumination receptor when said arm member in its operable position contacts an upper sheet corresponding to a low paper level condition.

5. A sensor for determining that a level of paper in a paper feeding machine has reached a predetermined low level condition comprising:

a shaft mounted in said paper feeding machine adjacent a path defined by on ingress and egress of an insertable module for supplying paper;

a lever mounted on said shaft for pivoting thereabout, said lever having a first end biased to occupy a first position extending into the path of said insertable module when no insertable module is present, and occupying a second position pivoted out of the path of said insertable module when said insertable module is inserted into said paper feeding machine;

first spring means for biasing said lever in said first position;

arm member having a first end adapted for pivotally mounting said arm member to said shaft and a second end biased to occupy an engaged position contacting an uppermost sheet of paper in said insertable module when said lever is in said second position, said second end occupying a retracted position out of said path of said insertable module when said lever is in said first position;

second spring means subservient to said first spring means and operating in an opposite direction for biasing said arm member in said engaged position only when said lever is in said second position; and circuit means cooperating with said arm member for determining when said second end of said arm member reaches an adjustable position corresponding to a low paper level condition, said circuit means having a normal status condition and a low paper status condition, said adjustable low paper status condition triggered by said arm member reaching said position corresponding to said low paper level condition.

6. The sensor as recited in claim 5 further comprising a housing having first and second sides, said housing adapted for mounting said sensor in said paper feeding machine wherein said shaft is mounted between said first and second sides of said housing.

7. The sensor as recited in claim 5 further comprising a traverse rod extending from said lever generally parallel to said shaft, said traverse rod contacting said arm member and inhibiting said second end of said arm member from occupying said engaged position when said lever is in said first position.

8. The sensor as recited in claim 7 wherein said first end of said arm member includes an interrupter plate radially spaced from said first end and projecting generally perpendicular to said shaft, said interrupter plate and said second end of said arm member adapted to pivot in a fixed relationship.

9. The sensor as recited in claim 8 wherein said traverse rod contacts said arm member at said interrupter plate to inhibit said second end of said arm member from occupying said engaged position when said lever is in said first position.

10. The sensor as recited in claim 8 wherein said circuit means comprises a light source and a light receptor operable positioned to receive light from said light source when a path between said light source and said light receptor is unimpeded, said light source and said light receptor positioned on opposite sides of an arced path defined by the pivoting of said interrupter plate.

11. The sensor as recited in claim 10 wherein said circuit means is positioned along said arced path defined by the pivoting of said interrupter plate at a location where said interrupter plate is disposed between said light source and said light receptor, thereby indicating a low paper status condition, when said second end of said arm member reaches said position corresponding to said low paper level condition.

12. The sensor as recited in claim 11 further comprising means for maintaining said interrupter plate disposed between said light source and said light receptor, thereby indication a low paper status condition, when said level of paper is further depleted below said low paper level condition.

13. The sensor as recited in claim 11 further comprising means for varying the level of paper corresponding to said low paper level condition.

14. The sensor as recited in claim 13 wherein said means for varying the level of paper corresponding to said low paper level condition comprises means for altering the position of said circuit means along said arced path defined by said interrupter plate.

15. The sensor as recited in claim 14 wherein said means for altering the position of said circuit means comprises a knob mounted to said sensor having threaded means cooperating with said circuit means for positioning said circuit means along said arced path defined by said interrupter plate.

16. The sensor as recited in claim 10 wherein said circuit means is positioned along said arced path defined by the pivoting of said interrupter plate at a location where said interrupter plate is not disposed between said light source and said light receptor, thereby indicating a low paper status condition, when said second end of said arm member reaches said position corresponding to said low paper level condition.

* * * * *